US007140086B2

(12) United States Patent
Heaton

(10) Patent No.: US 7,140,086 B2
(45) **Date of Patent: *Nov. 28, 2006**

(54) ADJUSTABLE SUPPORT ASSEMBLY

(76) Inventor: Kenneth Heaton, 4533 Josie Ave., Lakewood, CA (US) 90713

( * ) Notice: Subject to any disclaimer, the term of this patent is extended or adjusted under 35 U.S.C. 154(b) by 0 days.

This patent is subject to a terminal disclaimer.

(21) Appl. No.: 11/377,848

(22) Filed: Mar. 16, 2006

(65) Prior Publication Data

US 2006/0156523 A1 Jul. 20, 2006

Related U.S. Application Data

(63) Continuation-in-part of application No. 10/843,602, filed on May 11, 2004, now Pat. No. 7,024,743.

(51) Int. Cl.
*B66F 3/08* (2006.01)
*B23P 19/04* (2006.01)
*A47F 5/00* (2006.01)

(52) U.S. Cl. ..... 29/271; 29/256; 29/266; 254/98; 254/100; 254/133 R; 254/134; 248/354.3

(58) Field of Classification Search ..... 29/271, 29/256, 266; 254/98, 100, 133 R, 134; 248/354.3
See application file for complete search history.

(56) References Cited

U.S. PATENT DOCUMENTS 4,767,106 A * 8/1988 Le Fol ..... 248/636
7,024,743 B1 * 4/2006 Heaton ..... 29/271

* cited by examiner

*Primary Examiner*—Robert C. Watson
(74) *Attorney, Agent, or Firm*—I. Michael Bak-Boychuk

(57) ABSTRACT

A support assembly useful in supporting a plumbing fixture in the course of effecting connections thereto includes a base provided with a vertical tube segment supporting a nut assembly threadably engaged to a rod partly received in the segment with the upper rod end supporting an adapter conformed to the supported fixture. An offset bar fixed to the rod exterior engages a lateral recess on the segment to fix the rod in rotation as the nut assembly is turned. The assembly may include rods of differing lengths and adapters of various forms.

7 Claims, 4 Drawing Sheets

ADJUSTABLE SUPPORT ASSEMBLY

REFERENCE TO RELATED APPLICATIONS

This application is a continuation-in-part of U.S. patent application Ser. No. 10/843,602 filed on May 11, 2004 now U.S. Pat. No. 7,024,743 and the benefit of this earlier filing date is claimed for all matter common with this parent application.

BACKGROUND OF THE INVENTION

1. Field of the Invention

The present invention relates to tools useful in plumbing assembly, and more particularly to manually adjustable structures insertable under the free edges of a cantilevered sinks and the like while plumbing connections are effected to the drain openings thereof.

2. Description of the Prior Art

The plumbing connection below a sink often include complex geometries confined in a small space that are sometimes compounded by items like a food debris macerators, or garbage disposal, in current implementation comprises an electromechanical structure of some bulk and mass. While many improvements have made to render these devices and their plumbing quite reliable, the complex nature of the mechanism and the frequency of its use and abuse make it an item of frequent attention. Most often this attention requires removal and replacement, or re-installation following repair, of the device to the underside of the sink drain opening, a task requiring manipulation of a fairly heavy and cumbersome article within the narrow and crowded confines of the cavity under the sink.

Various tools have been devised in the past that assist in this difficult task most often taking the form of a threaded puller supported over the drain opening and extending through the drain fitting to suspend the macerator. Examples of such prior art devices can be found in the teachings of U.S. Pat. No. 6,557,229 to Ricci, U.S. Pat. No. 5,177,853 to Herook and others. While suitable for the purposes intended support mechanisms of this nature typically deploy the adjustment elements of the tool on top of or inside the sink cavity while all the alignments are made within the cabinet under the sink. This distant adjustment facility of these prior art devices has rendered their use less than fully convenient.

Those skilled in the art will appreciate that the alignment task of a disposal installation entails several aspects, including the attachments of the disposal to the sink flange, the connection of electrical leads and also the connection of the various drain lines. These tasks are all effected within the narrow confines of the sink cabinet. A disposal support mechanism that is conveniently manipulated with one hand while the other elements are brought out for connection with the other is therefore extensively desired. Significantly, these same tool adjustment attributes can be also utilized in other plumbing tasks. For example, those engaged in effecting plumbing connections beneath a cantilevered sink assembly will appreciate that such can only be accessed once the supporting pedestal is moved to the side, requiring some upward lifting of the free edge of the sink to provide both support and movement clearance adjustment to move the pedestal to the side. These concurrent functions and the tight quarters dictate one-handed tool manipulation and a mechanism that provides these attributes is extensively sought.

SUMMARY OF THE INVENTION

Accordingly, it is the general purpose and object of the present invention to provide mount assembly conformed for one-handed adjustment of the length thereof.

Other objects of the invention are to provide an adjustable support assembly conformed for manual adjustment to a supporting dimension subjacent an article held in a lifted position.

Further objects of the invention are to provide a support assembly useful in temporary positioning of articles while effecting repairs subjacent thereof.

Yet other objects of the invention are to provide an installation support which is adaptable to various configurations and is easily manipulated for proper alignment.

Briefly these and other objects are accomplished within the present invention by providing a generally planar base surface conformed to threadably engage one end of a pipe segment aligned in a generally orthogonal projection therefrom. The free end of the segment is both finished to form a smooth bearing surface and is further fixed to the upper end of an exterior longitudinal channel to provide a radial recess extending longitudinally along the exterior surface of the segment. A selected one of a complement of various length threaded rods first threaded through the interior of a nut assembly is then inserted into the segment such that the extending portion thereof is then receivable within the upper opening of the segment with the nut assembly supported on the surrounding bearing surface. In this manner rotary advancement of the nut assembly raises and lowers the free projecting end of the inserted rod which may be threadably secured to one of several adaptor fixtures conformed in a first embodiment to mate with a corresponding bottom structure of a disposal that is being installed and in the second embodiment to a supporting cradle for other articles. To prevent the adaptor-rod combination from turning with the nut assembly as it is rotated a threaded sleeve mounted on the rod is locked by compression against the adaptor to deploy a longitudinal bar along the rod exterior into the recess in the channel along the pipe segment.

Those skilled in the art will further appreciate that the foregoing combination is easily conformed to various sink cabinet, disposal geometries and other structures. In each instance, moreover, the thread pitch of the nut assembly and weight of the supported article are combined with the contact dimensions of the base plate to preclude the rotary movement thereof as the article is raised. The plumber engaged in the replacement or other installation task thus needs only one hand to manipulate the nut assembly leaving the other hand free for fitting alignments obtained by a simple and reliable tool that effectively resolves a tedious and cumbersome task.

BRIEF DESCRIPTION OF THE DRAWINGS

FIG. 5 is a further perspective illustration of the inventive support assembly detail, illustrating another adaptation thereof to a particular disposal;

DESCRIPTION OF THE PREFERRED EMBODIMENT

Figure 1:
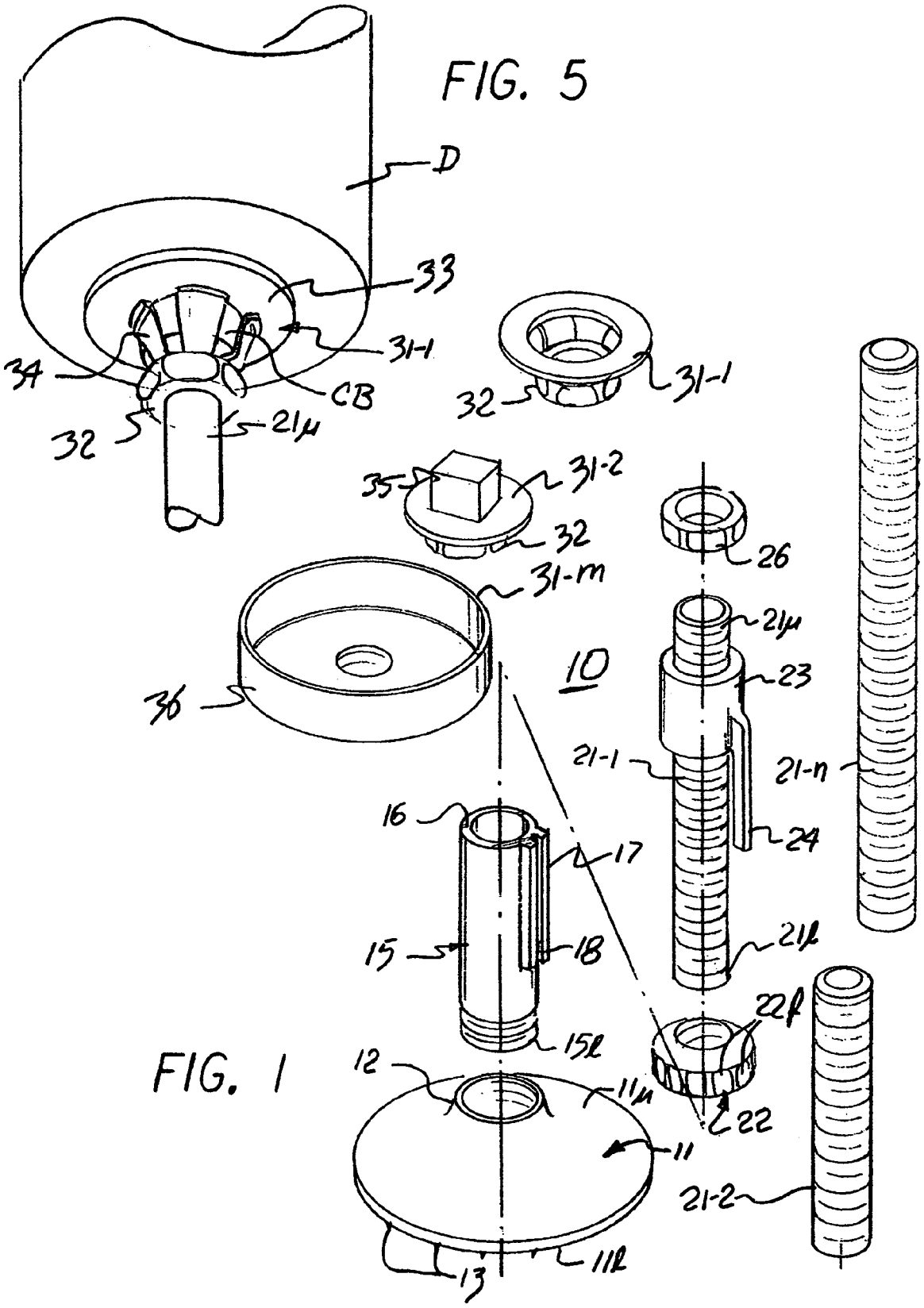
FIG. 1 is a perspective illustration, separated by parts, of the inventive support assembly useful in the course of installation of a food debris macerator or garbage disposal.
Figure 2:
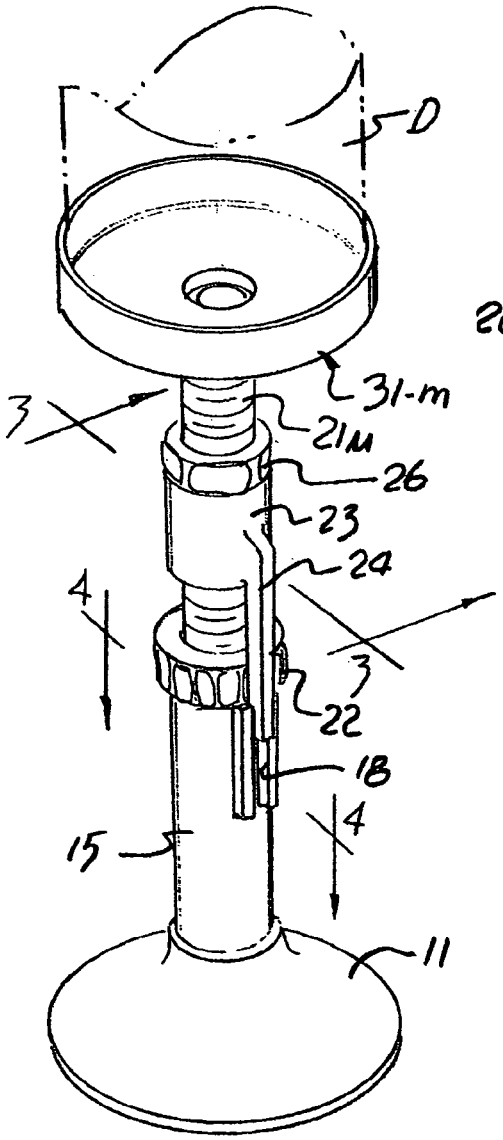
FIG. 2 is yet another perspective illustration of the inventive support assembly in its deployed form.
Figure 3:
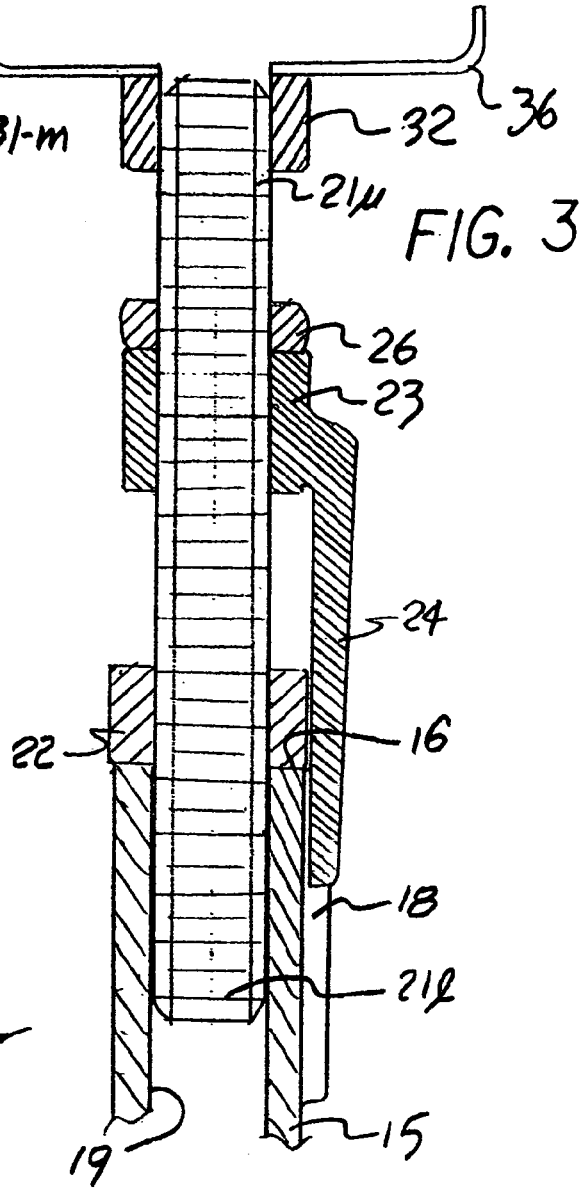
FIG. 3 is a sectional view taken along line 3—3 of FIG. 2.
Figure 4:
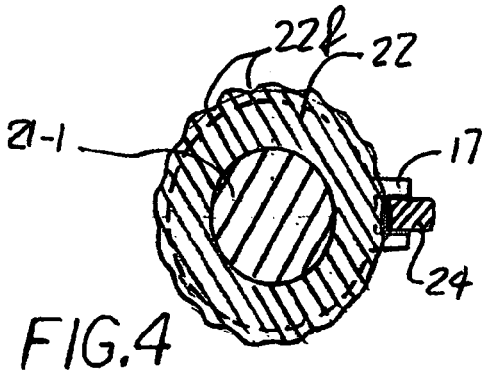
FIG. 4 is yet another sectional view taken along line 4—4 of FIG. 4.

As shown in FIGS. 1–4, the inventive support assembly, generally designated by the numeral 10, comprises a base 11 of a generally planar configuration provided with a threaded boss 12 on the upper surface 11*u* thereof. The peripheral edge surface of the lower surface 11*l* may be finished to a rough finish, shown by projections 13, to increase frictional resistance to any rotary displacement thereof A pipe segment 15 exteriorly threaded over the lower end surface 15*l* is then threadably insertable into the boss 12 to form a vertically aligned annular structure supported on the base and defined at the upper end 15*u* by a smoothed end surface 16. A longitudinally aligned channel piece 17 is then affixed to the outer surface of segment 15 to present a radially directed recess 18 extending from surface 16 along a portion of segment 15.

A selected one of a plurality of threaded rods 21-1 through 21-*n*, shown as rod 21-1 in the Figure, is then threadably received in the interior of a nut assembly 22 to extend a lower portion 211 into the interior bore 19 of segment 15. This extension is limited by the resting abuttment of the assembly 22 against the smoothed surface 16 and is adjustable by the rotary advancement of the assembly on rod 21-1. In this manner the extension of the upper rod portion 21*u* is manually selectable by rotary manipulation of the nut assembly. To allow for such one-handed manipulation of the nut assembly 22 on rod 21-1 a threaded sleeve 23 is advanced onto the upper rod segment 21*u* to deploy an offset bar 24 aligned for receipt within recess 18, thus fixing the rod in rotation. To further secure sleeve 23 on the rod a clamping nut 26 may be provided, or alternatively the sleeve may be compressed against any support adaptors that may be threaded onto the rod end. Of course, these alternatives depend on the length of the rod selected and the desired height of the adapter deployment, a dimension determined by the size of the article supported on the adapter and the height to which it needs to be raised.

Those skilled in the art will appreciate that commercially available disposals D are variously implemented and the geometry of their lower surfaces will therefore need various conforming support structures. For this reason a plurality of adapters 31-1 through 31-*m* is provided as a part of the assembly array each conformed to a particular disposal geometry and each characterized by a central mounting nut 32 conformed for mounting on the corresponding upper rod end 21*u*. For example, for those configurations of the disposal D provided with an annular central boss CB (see FIG. 5) the structure of adapter 31-1 provides an annular ring 33 mounted on nut 32 by a spider 34. Alternatively, disposals D provided with a key opening in their lower surface for clearing jams may take advantage of the adapter 31-2 provided with an upward key 35 and configurations that include a flat lower surface may use the dished support 36 shown on adaptor 31-*m* (and illustrated in FIGS. 2 and 3). Of course, other disposal shapes can be similarly accommodated.

In each instance it is the deployment convenience of a support structure that is easily adjusted that is desired, particularly when raising the disposal into compressive contact with the seals and brackets that form the mounting structure. To preclude inadvertent reduction in height a retention interlock is conveniently formed by providing a series of flats or depressions 22*d* on the periphery of the nut assembly 22 on which the offset bar 24 rests as it is cantilevered from sleeve 23. The manual advancement of the nut assembly is therefore against a spring bias, assuring positive engagement at the position selected. In this manner a conveniently assembled tool is provided that is easily configured for various installation geometries. Moreover, the generally conventional nature of most of the components of the assembly assures a broad selection of materials such as metal, PVC or other polymeric structures.

Of particular interest to those engaged in the installation or re-installation of disposals and macerators is the range of utility of this support assembly which can be further expanded by combining the several pieces in any selection. For example the very short rod 21-2 may be combined with one of the other, longer, ones by threaded insertion into both the ends of sleeve 23 and the annular support 31-1 may be combined with adapter 31-2 for those instances where both a key opening and a central boss is included in the disposal end. Thus a wide range of shapes and dimensions is conveniently accommodated.

Figure 6:
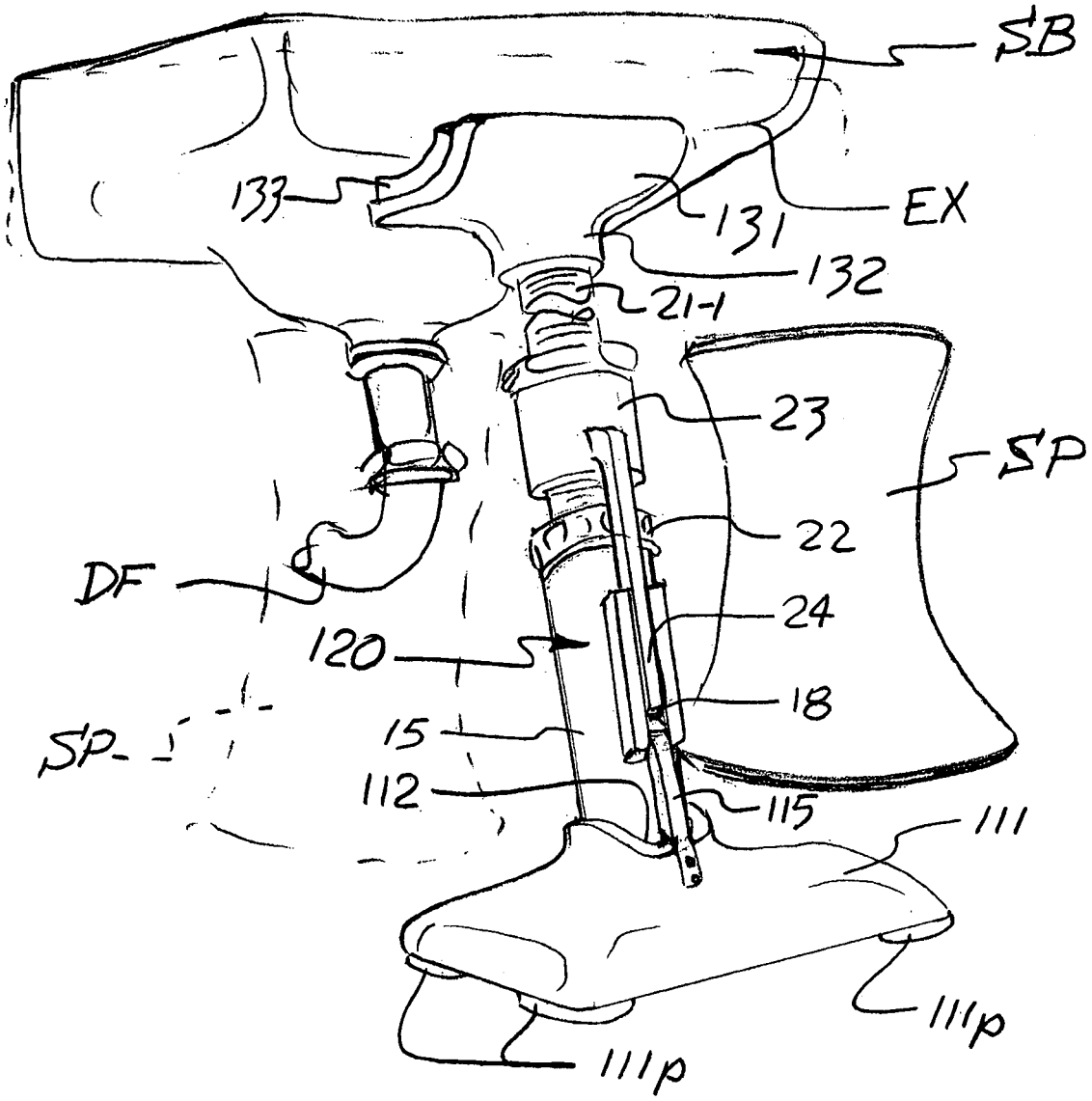
FIG. 6 is yet a further perspective illustration of the inventive support assembly conformed for lifting and supporting a pedestal mounted sink while plumbing repairs are effected.
Figure 7:
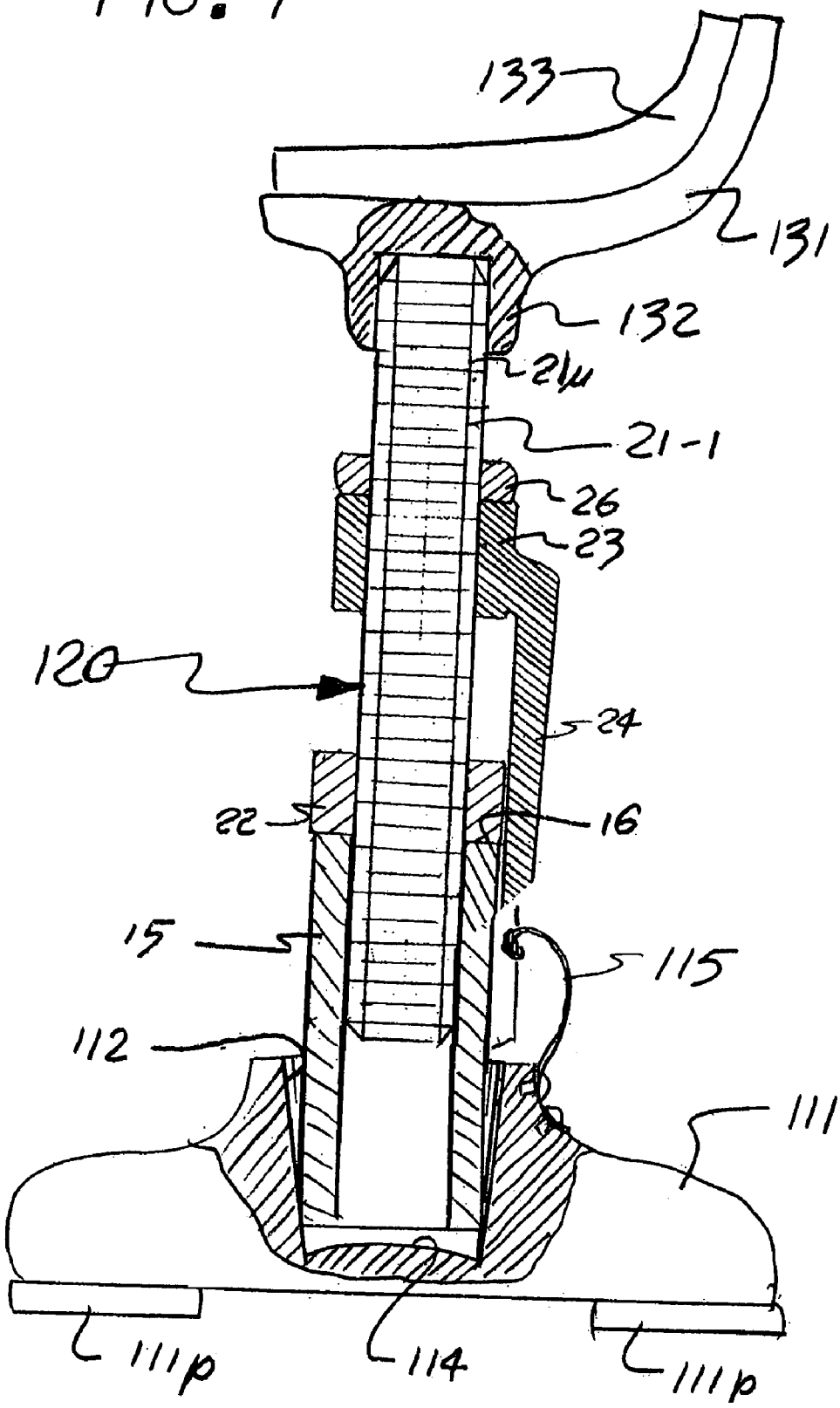
FIG. 7 is a side view, in partial section, of the inventive support assembly in the course of its use according to the illustration in FIG. 6.

By particular reference to FIGS. 6 and 7 the usefulness of the above-described support assembly may be extended to tasks other than those entailed in mounting a food debris macerator. For example, and not by way of a limitation, the assembly may be conveniently adapted to provide support for cantilevered sink basins while the usually provided pedestal support is removed to obtain access to the drain plumbing. Like numbered parts functioning in a like manner to that previously described, the threadably expansive combination of the threaded rod 21-1, with the nut assembly 22 and sleeve 23 engaged thereon is once again receivable in the upper opening of the pipe segment 15 with the offset bar 24 again extending in the radial recess 18 on the segment's exterior. This combination, generally designated herein by the numeral 120, is then engaged and threadably locked by bottoming the upper end of rod 21-1 in a threaded boss 132 formed on the underside of a transverse upper cradle 131 conformed to support the exterior edge EX of a cantilevered sink basin SB. The lower end of the pipe segment 15, in turn, is then received in a frustoconical cavity 112 formed in the upper surface of a generally rectangular base piece 111. Preferably, recess 112 includes an interior bottom surface 113 of a planform generally equal to the sectional dimension of segment 15 while the upper opening 114 of the recess defines a larger space to allow for some angular displacement of assembly 120 relative the base piece 111. A leaf spring 115 cantilevered from the base piece 111 extends to also engage the recess 18 to oppose rotation of the segment 15 within cavity 112. A resilient pad 133 in cradle 131 together with a set of resilient pads 111*p* on the lower surface of the bade piece then provide the necessary retention against sliding while also protecting the surfaces of the work site.

Those in the art will appreciate that this supporting assembly, once in place, is particularly suited for a one-handed manipulation of the nut assembly 22 while the other hand can be used to move the sink pedestal SP out of the way and thereafter to manipulate the drain fittings DF. Moreover, other supporting tasks can be similarly assisted by this assembly limited only by the complement of the red pieces and end fittings provided. In this manner a single tool complement conveniently accommodates a single person in effecting tasks that heretofore required the assistance of others.

Obviously, many modifications and variations can be effected without departing from the spirit of the invention instantly disclosed. It is therefore intended that the scope of the invention be determined solely by the claims appended hereto.

The invention claimed is:

1. An adjustable assembly useful in supporting articles, comprising:

a base structure characterized by a base plate provided with a generally frustoconical cavity in the upper surface thereof for supporting receipt of the lower end of a tubular segment provided with a radially aligned recess on the exterior periphery thereof adjacent an upper opening in said segment;

a threaded rod defined by an upper and a lower end threadably engaged to extend said lower end through a nut assembly for receipt into the upper opening of said segment and to threadably extend said upper end through a sleeve provided with an offset bar extending over said nut assembly into said recess; and an adapter attachable to said upper end of said rod and conformed to support said article.

2. An assembly according to claim 1, wherein:

said rod is selected from a group of rods of various lengths; and said adapter is selected from a group of adapters each conformed for supporting a particularly configured article.

3. An assembly, according to claim 2, wherein:

said nut assembly includes a plurality of radial depressions in the periphery thereof; and said bar is cantilevered from said sleeve to extend through a selected one of said depressions.

4. An assembly, according to claim 3, wherein:

said base structure further includes a leaf spring affixed to extend in cantilever adjacent said frustoconical cavity in receiving alignment within said radial recess.

5. An adjustable assembly conformed for manual extension, comprising:

a base structure characterized by a base plate provided with a generally frustoconical cavity in the upper surface thereof for supporting receipt of the lower end of a tubular segment provided with a radially aligned recess on the exterior periphery thereof adjacent an upper opening in said segment, said base structure further including a leaf spring affixed to extend in cantilever adjacent said frustoconical cavity in receiving alignment within said radial recess;

a threaded rod selected from a group of rods of various lengths each defined by an upper and a lower end threadably engaged to extend said lower end through a nut assembly for receipt into the upper opening of said segment and to threadably extend said upper end through a sleeve provided with an offset bar extending over said nut assembly into said recess; and an adapter selected from a group of adapters each conformed for supporting a particularly configured article and each attachable to said upper end of said rod and conformed to support said macerator.

6. An assembly, according to claim 5, wherein:

said nut assembly includes a periphery provided with a plurality of radial depressions; and said bar is cantilevered from said sleeve to extend through a selected one of said depressions.

7. An assembly according to claim 6, wherein:

said rod is selected from a group of rods of various lengths.

* * * * *